US007954169B2

(12) United States Patent
Rumer et al.

(10) Patent No.: US 7,954,169 B2
(45) Date of Patent: Jun. 7, 2011

(54) BASEBALL GLOVES WITH FLEXIBILITY FOLDS

(75) Inventors: Tim Rumer, Norcross, GA (US); Kenji Maeda, Osaka (JP); Tuan Le, Portland, OR (US)

(73) Assignee: Mizuno USA, Norcross, GA (US)

( * ) Notice: Subject to any disclaimer, the term of this patent is extended or adjusted under 35 U.S.C. 154(b) by 716 days.

(21) Appl. No.: 11/773,552

(22) Filed: Jul. 5, 2007

(65) Prior Publication Data

US 2009/0007307 A1 Jan. 8, 2009

(51) Int. Cl.
*A41D 13/08* (2006.01)
*A41D 19/00* (2006.01)
*A63B 71/14* (2006.01)

(52) U.S. Cl. ..... 2/19; 2/161.1

(58) Field of Classification Search ..... 2/16, 19, 2/20, 159, 161.1; D29/123; D21/780
See application file for complete search history.

(56) References Cited

U.S. PATENT DOCUMENTS 2,681,448 A * 6/1954 Tompkins ..... 2/19
4,227,263 A * 10/1980 Zidele ..... 2/19
4,527,287 A 7/1985 Aoki
4,847,915 A 7/1989 Keene
5,448,775 A * 9/1995 Yamada et al. ..... 2/19
5,551,083 A * 9/1996 Goldsmith ..... 2/19
5,717,994 A * 2/1998 Goldsmith ..... 2/19
6,182,289 B1 * 2/2001 Brown ..... 2/19
2004/0216207 A1 * 11/2004 Anderson ..... 2/19
2008/0250540 A1 * 10/2008 Aoki ..... 2/19

* cited by examiner

*Primary Examiner* — Gary L Welch
*Assistant Examiner* — Amber R Anderson
(74) *Attorney, Agent, or Firm* — Troutman Sanders LLP; James E. Schutz; Jihan A. R. Jenkins

(57) ABSTRACT

An athletic glove having an enhanced flexibility features for assisting in the opening and closing of the glove. A glove can include a front ply forming a palm and front portion and a back ply forming a back portion. The peripheries of the front and back plies attached together to form the glove. The glove includes a thumb stall, at least on finger stall, a hand receiving opening, a heel portion of the front ply, and a web portion positioned between the thumb stall and the finger stall. The glove further includes at least one predefined fold in the palm, such that the fold increases the flexibility of the glove and thereby facilitates the opening and closing of the glove. The glove can also comprise a notch formed in the back ply between the finger stall and the hand receiving opening to further increase the flexibility of the glove. Other embodiments are also claimed and described.

23 Claims, 3 Drawing Sheets

BASEBALL GLOVES WITH FLEXIBILITY FOLDS

TECHNICAL FIELD

The various embodiments of the present invention relate generally to a baseball and softball glove and, more particularly, to an athletic glove with strategically positioned folds and a palm notch adapted to allow the glove to be more readily opened or closed.

BACKGROUND

Conventional athletic gloves or mitts, such as baseball or softball gloves, often require a "break-in" period before the glove is ready for maximum use. New ball gloves are particularly difficult to close due to a stiff heel portion of the palm of the glove, which requires an individual to fold, open, and close the glove repeatedly until a desired flexibility is reached. When presented with a new baseball glove, boys and girls often fold the glove around a baseball and place the glove under a mattress to assist in the breaking-in of the glove. Generally, a more flexible glove allows an individual to better catch a ball during play.

The heel portion of the glove commonly comprises a stiff padded portion between several layers of thick leather, which are stitched together. The heel portion's thickness increases the difficulty of creasing a new glove, thereby making the glove difficult to open and close, particularly for younger ball players with less hand strength.

The need to enhance the flexibility of a baseball glove for the purpose of reducing break-in time has been recognized by the industry. For example, U.S. Pat. No. 4,527,287 is directed to a baseball glove having an area of increased flexibility. The area of increased flexibility is located on a backside of the glove, below the finger stalls, and directly above an opening for receiving the ball player's hand. The disclosed area of increased flexibility facilitates opening and closing of the glove.

In another example, U.S. Pat. No. 4,847,915 discloses a baseball glove having a means to enhance glove flexibility. The disclosed flexibility means employs a flexible heel portion which facilitates closing of the glove.

While the prior disclosures of U.S. Pat. Nos. 4,527,287 and 4,847,915 allow for enhanced glove flexibility, no such known design has been developed which would virtually eliminate the break-in period for a new ball glove. By eliminating the break-in period, young ball players may gain greater control over the glove in a shorter period of time than that required by other more conventional gloves.

Accordingly, there is a need for an athletic glove having enhanced flexibility, thereby eliminating the need to break-in a new ball glove. Such an athletic glove has particular use among younger ball players or among those who have less hand strength. It is to such an athletic glove that embodiments of the present invention are directed.

BRIEF SUMMARY

Briefly described, various embodiments of the present invention relate to an athletic glove having an enhanced flexibility feature for assisting in the opening and closing of the glove. According to one embodiment of the present invention, the athletic glove includes a front ply forming a palm and front portion of the glove and a back ply forming a back portion of the glove. The peripheries of the front ply and the back ply are attached together, such as by a binding thread, to form the glove. The athletic glove includes a thumb stall, at least one finger stall, a hand receiving opening, a heel portion at a lower portion of the front ply, and a web portion positioned between the thumb stall and the at least one finger stall. The glove further includes at least one predefined fold in the palm of the front ply, such that the at least one predefined fold increases the flexibility of the glove and thereby facilitates the opening and closing of the glove. The athletic glove also comprises a notch formed in the back ply of the glove between the at least one finger stall and the hand receiving opening. The notch is adapted to further increase the flexibility of the glove and facilitate the opening and closing of the glove.

More specifically, some embodiments relate to a baseball glove having a plurality of predefined folds in the palm of the glove to increase the flexibility of the glove during opening and closing. Each flexibility fold includes a first end positioned adjacent the notch and a second end positioned adjacent the web portion of the glove. Further, each flexibility fold can include stitching extending from the first end to the second end of the fold.

Embodiments of the present invention can also include a plurality of predefined seams in the palm of the glove to increase the flexibility during the opening and closing of the glove. Each predefined seam includes a first end positioned adjacent the notch and a second end positioned adjacent a finger stall or thumb stall. Generally, each finger stall and thumb stall is adjacent to a corresponding seam within the palm of the glove.

The baseball glove has a V-shaped notch including first and second notch portions in the front and back plies, respectively, between a finger stall and the hand receiving opening. The notch portions are disposed opposite one another at a lower portion of the palm such that the notch extends through an entire cross section of the glove. The first and second notch portions are separately bound so that the notch collapses upon itself when the glove is closed, thereby facilitating easier opening and closing of the glove.

Embodiments of the present invention can also include at least one web slit formed in an upper edge of the web portion within the baseball glove for increasing glove flexibility by reducing the web portion's resistance to bending or creasing. In a preferred embodiment, several slits are formed on the upper edge of the web portion between the index finger stall and web lacing wrapped around the upper edge of the web portion. Normally, the web lacing increases the stiffness of top edge. Advantageously, embodiments of the present invention, however, provide for a break in the lacing near the index finger stall allowing a crease or fold to readily form in the web portion near the slits, thereby providing additional flexibility on the top of the web portion. Thus, the break in web lacing in combination with the slits maximizes web flexibility.

The predefined folds, web slits, web lacing arrangement, and the V-shaped notch in the lower portion of the glove palm may each be used in various combinations with each other to maximize flexibility of any type of baseball glove. The illustrated embodiment utilizes the predetermined folds, the web slits, and the V-shaped notch in the palm to maximize flexibility, thereby facilitating opening and closing of the glove.

Accordingly, it is an object of the present invention to provide for an improved baseball glove design which allows for enhanced glove flexibility.

It is another object of the present invention to provide for a baseball glove which allows for enhanced glove control.

Another object of the present invention is to provide for a baseball glove which eliminates the need for a break-in period.

Yet another object of the present invention is to provide for a baseball glove having structure which allows the glove to readily crease across a palm portion of the glove.

It is another object of the present invention to provide for a baseball glove which closes quickly around a ball.

Another object of the present invention is to provide for a baseball glove which is pleasing in appearance and durable in construction.

Other objects, features, and advantages of the present invention will become apparent to those skilled in the art upon reading the following specification in conjunction with the accompanying drawings.

DETAILED DESCRIPTION OF PREFERRED & ALTERNATIVE EMBODIMENTS

Figure 1:
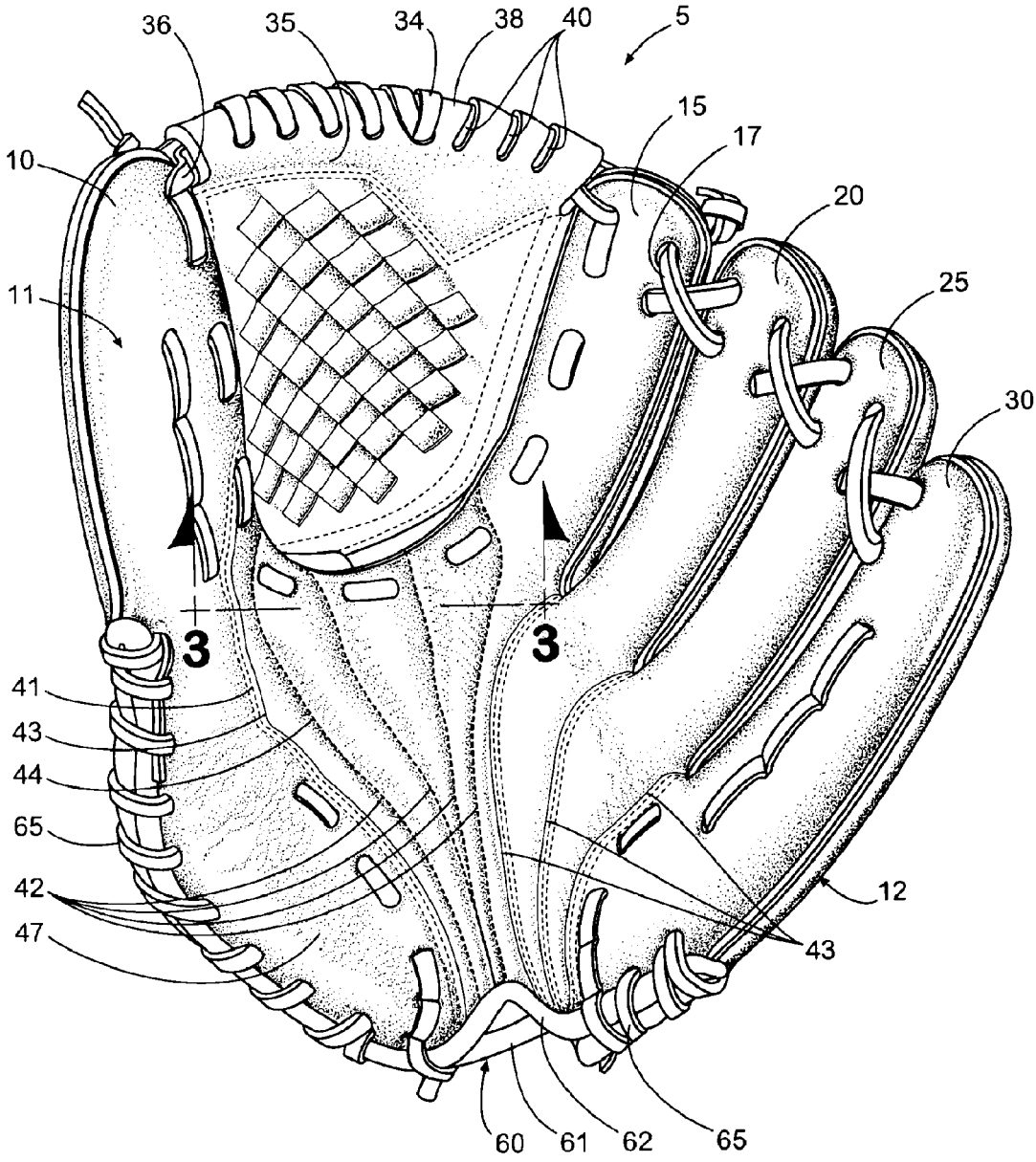
FIG. 1 illustrates a front perspective view of an athletic glove in an open position in accordance with a preferred embodiment of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented.

Figure 2:
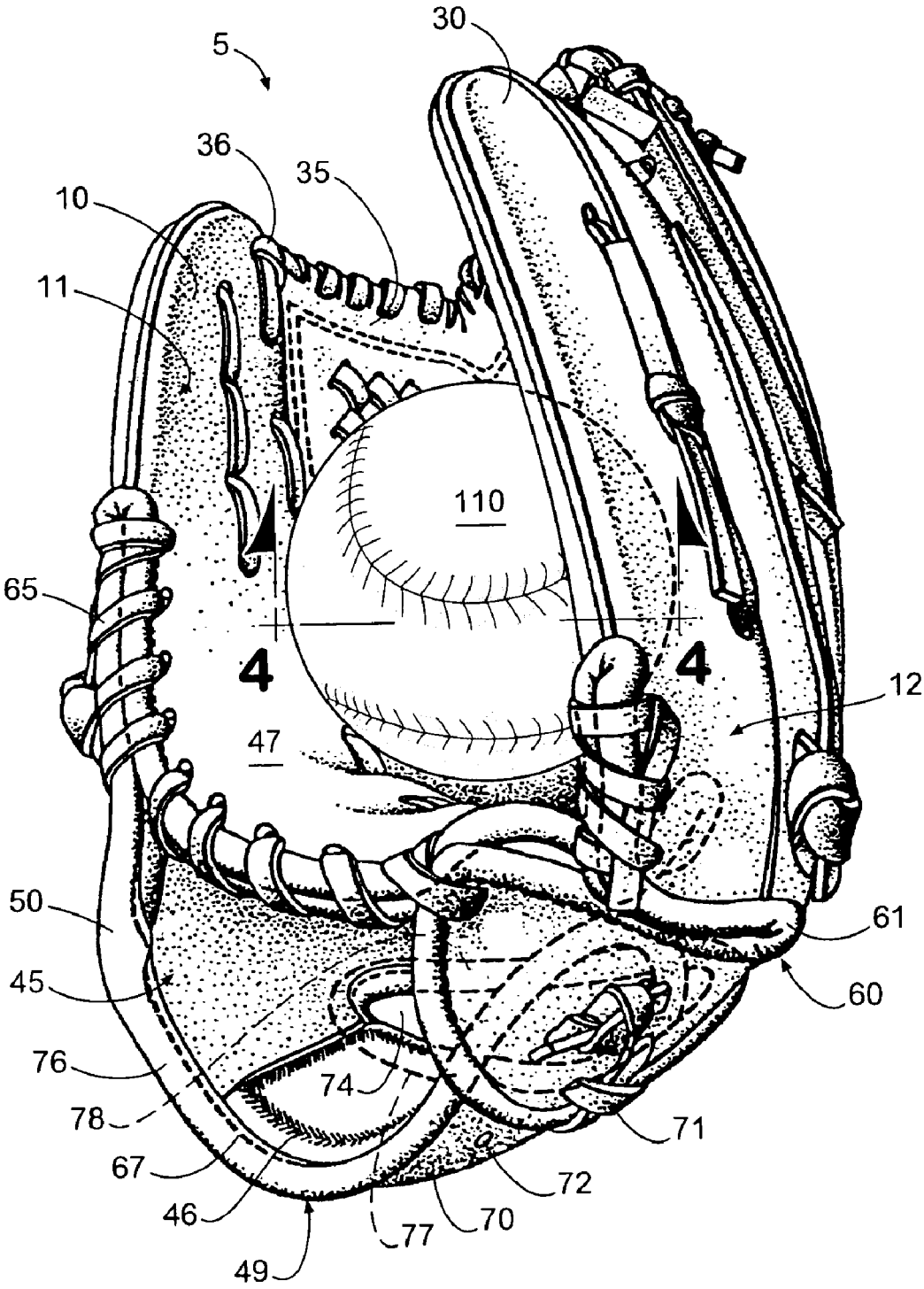
FIG. 2 illustrates a front, bottom, right side perspective view of an athletic glove clutching a ball in the closed position in accordance with a preferred embodiment of the present invention.

Referring now specifically to FIGS. 1 and 2, these figures illustrate an athletic glove 5, according to an embodiment of the present invention, having increased flexibility, thereby eliminating the need to break-in a new athletic glove 5 prior to effective use during play. The athletic glove 5 has particular use among younger ball players or among those who have limited hand strength. One skilled in the art will recognize that the athletic glove 5 can be constructed from a variety of flexible material, including, but not limited to, leather.

Generally, the glove 5 is constructed from a front panel or ply 11 which forms a front portion of the glove 5 and a back panel or ply 12 which forms a back portion of the glove 5. The front ply 11 and the back ply 12 can be fastened or attached together by any suitable means (e.g., stitching) to form athletic glove 5 having a thumb stall 10 as well as finger stalls 15, 20, 25, and 30, which typically house at least part of an individual's fingers during use. An inner portion of the glove 5 can include an inner liner (not shown) fastened to front ply 11 so that appropriate padding or filler (not shown) may be inserted therebetween.

A web portion 35 can be fastened or attached to glove 5 between thumb stall 10 and index finger stall 15 by an attachment mechanism 36 (e.g., lacing or any other suitable fastening means). Each of the finger stalls 15, 20, 25, and 30 are fastened or attached to each adjacent finger stall by an attachment mechanism 17 (e.g., lacing or other suitable fastening means), so that the thumb stall 10, web portion 35, and finger stalls 15, 20, 25, and 30 are stabilized with respect to one another. A plurality of web slits 40 are formed in a top portion of the web portion 35 near adjacent lace loop 34 and serve to increase flexibility of the athletic glove 5, discussed more fully below.

As illustrated in FIG. 2, a strap 70 can be integral with back ply 12 and originates from a lower portion of the back ply 12 below web portion 35 and thumb stall 10. An outside edge 76 of the strap 70 forms a first edge of a hand receiving opening 45. A lower peripheral edge 78 of back ply 12 and an upper peripheral edge 77 of the strap 70 collectively form a border inner opening 74. The strap 70 may be fastened or attached by an attachment mechanism 71 (e.g., a lace or other suitable fastening means, such as snaps, Velcro™, stitching, etc.) through eyelets 72 to a lower portion 55 of back ply 12. The strap 70 may be adjusted for different sized wrists by choosing the appropriate set of eyelets 72 on the strap 70. Strap 70 can also include a wrist pad 46 on an inner portion thereof to insure that the strap 70 fits snugly and comfortably around the individual's wrist and hand.

The hand receiving opening 45 of the athletic glove 5 is generally bordered on a top portion by a heel portion 49 and is bordered on a lower portion by an outside edge 76 of the strap 70. The lower portions of the front ply 11, the inner liner (not shown) beneath the front ply 11, padding or filler (not shown) between the front play and inner liner, and continuous binding or lip 50 collectively form heel portion 49 at a lower periphery of the front ply 11. A V-shaped notch 60 is formed into the heel portion 49 and a palm 47 of the glove 5, below little finger stall 30. The V-shaped notch 60 has a front portion 62 formed in front ply 11 and a back portion 61 formed in back ply 12, so as to fully extend through a cross section of the glove palm 47 and heel portion 49. The front and back notch portions 62 and 61 are disposed opposite to one another when front ply 11 and back ply 12 are aligned and are separately bound by a continuous binding 50. The continuous binding 50 provides a finished, appealing appearance for the notch 60. Also, the separately bound front and back portions 62 and 61 of the notch 60 serve to increase the flexibility of the glove 5.

Continuous binding 50 forms a border for notch 60 as well as for the entire lower portion of the glove 5. Accordingly, continuous binding 50 extends along back ply 12 adjacent to pad 46 on the strap 70 to about a mid-point of an outer portion of thumb stall 10, and then reverses direction and runs generally parallel to itself on an edge of the front ply 11 along the outer portion of thumb stall 10. The continuous binding 50 continues along heel portion 49 of the front ply 11, bordering a top portion of the hand receiving opening 45, and forms a border for the front portion 62 of the notch 60 in the front ply 11. The continuous binding 50 then continues along an edge of the front ply 11 on an outer portion of the little finger stall 30, reverses direction and runs generally parallel to itself on an outer portion of the rear ply 12 on the little finger stall 30, borders the back portion 61 of the notch 60, and also borders a lower portion of the rear ply 12. The continuous binding 50 then forms an upper border of the inner opening 74 and forms an insider border of the strap 70.

An attachment mechanism 65 (e.g., lacing or other suitable fastening means) fastens or attaches both portions of the continuous binding 50 to each other near an outer periphery of the thumb stall 10. Stitching 67 fastens the continuous binding 50 to the front ply 11 and the back ply 12. A second portion of the attachment mechanism 65 can also fasten the front ply 11 and the back ply 12 along a lower, outer edge of the little finger stall 30.

The glove 5 can further comprise a plurality of predetermined flexibility folds 42 located on the palm 47 of the front ply 11. The flexibility folds 42 are built-in creases within the front ply 11, such that the folds 42 increase the flexibility of the glove 5 for opening and closing during use. The front ply 11 may also include stitching 44 within the flexibility folds 42 to further define the creases within the front ply 11, thereby allowing the glove 5 to open and close easier. The stitching 44 and folds 42 eliminate the need of a break-in period for a new athletic glove 5 while also facilitating in easing the strength required for closing the glove 5 about a ball.

Figure 3:
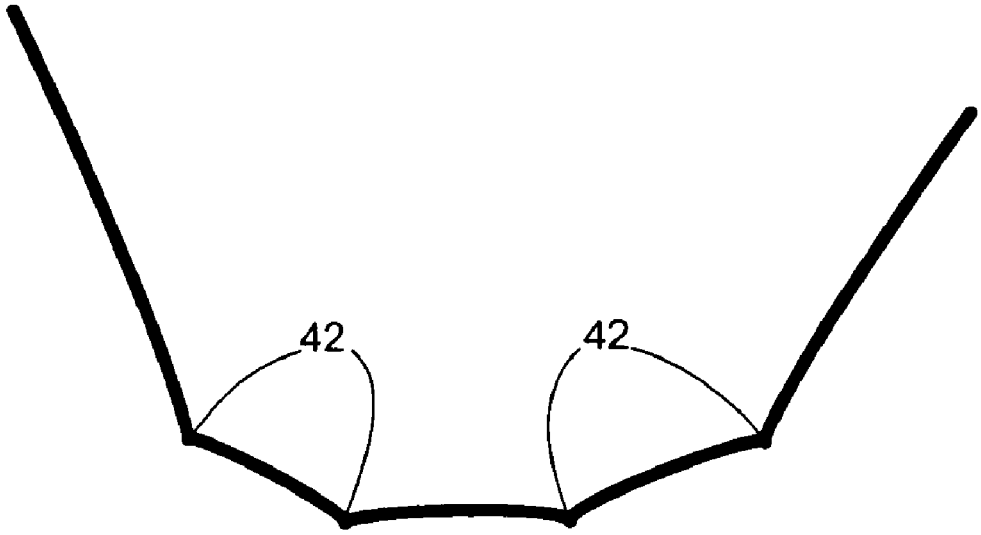
FIG. 3 illustrates a cross-sectional view of a plurality of flexibility folds of the athletic glove in an open position in accordance with a preferred embodiment of the present invention.
Figure 4:
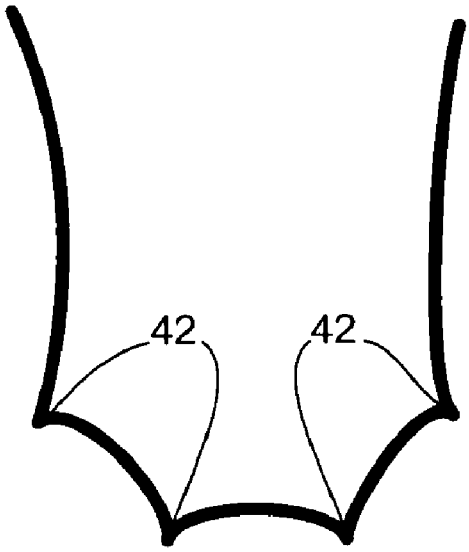
FIG. 4 illustrates a cross-sectional view of a plurality of flexibility folds of the athletic glove in a closed position in accordance with a preferred embodiment of the present invention.

Each flexibility fold 42 typically includes a first end positioned near or adjacent the notch 60 and a second end positioned near or adjacent the bottom of the web portion 35. More particularly, the second ends of the flexibility folds 42 may be evenly spaced near the bottom of the web portion 35, whereby the folds 42 run through the palm 47 of the front ply 11, such that the folds 42 generally merge towards each other as they approach notch 60. The flexibility folds 42 may or may not actually merge into a single fold as they run toward notch 60. As the stitching 44 runs along the folds 42, the stitching 44 may also merge toward each other as the folds 42 approach the notch 60. While any number of folds 42 may be effectively used within the present invention, the illustrated embodiment utilizes four folds 42, wherein the two inner folds 42 merge into each other near notch 60. FIGS. 3 and 4 illustrate cross-sectional views of the athletic glove 5 with flexibility folds 42, wherein the glove 5 is shown in the open position and closed position, respectively. In the open position, the athletic glove 5 is ready to accept a ball, wherein the palm 47 of the glove 5 is expanded. As an individual moves the glove 5 into a closed position, the palm 47 of the glove 5 creases along the folds 42 of the front ply 11. Such folds 42 provide increased flexibility and easier opening and closing of the glove 5.

Additionally, the glove 5 can further comprise a plurality of predetermined flexibility seams 43 located on the palm 47 of the front ply 11. The flexibility seams 43 are built-in overlaps within the front ply 11, such that the seams 43 increase the flexibility of the glove 5 for opening and closing during use. Moreover, the overlaps of the flexibility seams 43 create natural folding points of the front ply 11 of the glove 5, thereby further increasing the flexibility of the glove during use. The front ply 11 may also include stitching 41 running along the flexibility seams 43 to further define the overlaps within the front ply 11, thereby allowing the glove 5 to open and close more easily. The stitching 41 and seams 43 help to eliminate the need of a break-in period for a new athletic glove 5.

Each flexibility seam 43 typically includes a first end positioned near or adjacent the notch 60 and a second end positioned near or adjacent a thumb or finger stall 10, 15, 20, 25, and 30. More particularly, the second ends of each flexibility seams 43 may be evenly spaced adjacent a corresponding thumb or finger stall 10, 15, 20, 25, and 30, whereby the seams 43 run through the palm 47 of the front ply 11, such that the seams 43 generally merge towards each other as they approach notch 60. The flexibility seams 43, however, do not overlap or interfere with the flexibility folds 42, as described above.

More particularly, the seams 43 corresponding to the finger stall 15, 20, 25, and 30 may merge towards each other as they approach a first side of the notch 60, while a seam 43 corresponding to the thumb stall 10 may run towards a second and opposite site of the notch 60. The flexibility seams 43 may or may not actually merge into a single seam as they run toward the first side of the notch 60. As the stitching 41 runs along the seams 43, the stitching 41 may also merge toward each other as the seams 43 approach the first side of the notch 60. While any number of seams 43 may be effectively used within the present invention, the illustrated embodiment utilizes four seams 42, such that a first seam 42 has a second end located to the right of the thumb stall 10, a second seam 42 has a second end located to the right of the index finger stall 15, a third seam 42 has a second end located to the right of the middle finger stall 20, and a fourth seam 42 has a second end located to the left of the small finger ("pinky") stall 30.

The slits 40, notch 60, folds 42, and flexibility seams 43 serve to increase the flexibility of the athletic glove 5. FIG. 1 illustrates the V-shaped notch 60 in the open position. In an embodiment of the present invention, the V-shaped notch 60 is strategically positioned between the hand receiving opening 45 and a lower portion of the little finger stall 30, so as to eliminate a portion of the palm 47 that would resist a crease on the heel portion 49 during a break-in period. The seam comprised of the border of the front ply 11 and the back ply 12 below little finger stall 30 is stiffer than a middle portion of the palm 47, and that portion of the heel portion 49 has been removed to form a V-shaped notch 60 to decrease the stiffness of the same area.

As illustrated in FIG. 2, when the glove 5 closes, a top portion 62 of the notch 60 collapses onto a bottom portion 61 of the notch 60, eliminating the stiffness associated with creasing and bunching of the front ply 11, back ply 12, inner liner (not shown), and filler material (not shown) thereby allowing a young ball player or other having limited hand strength to easily open and close the glove 5, even when the glove 5 is relatively new.

The continuous binding 50 contributes to the flexibility of the V-shaped notch 60. As described above, the front portion 62 and back portion 61 of the notch 60 is bound separately. As displayed in FIG. 2, the separate binding arrangement allows the lower most portions or valley portions of the notch portions 61 and 62 to effectively function as hinges, allowing the top portion 62 to collapse onto the bottom portion 61 of the notch 60. The separate binding arrangement also allows for a space to be maintained between the valleys of the front and back notch portions 62 and 61 during collapse, thereby providing further flexibility. In addition to the separately bound portions 61 and 62 of the notch 60, a first portion of attachment mechanism 65 terminates at the bottom notch portion 61, while a second portion of attachment mechanism 65 terminates at the top notch portion 62, also allowing a distance to be maintained between the front and back notch portions which contributes to glove flexibility. Accordingly, an individual's hand can easily close the glove 5 to clutch a ball 110.

Slits 40 also increase the flexibility of the glove 5 by reducing the web portion's resistance to bending or creasing. While at least one slit 40 may be used, between two to four slits 40 generally provide better flexibility. The slits 40 are located in a break in lacing 34 along edge 38 of the web portion 35, thereby decreasing the stiffness of the top edge 38, and allowing a crease or fold to readily form in the web portion 35 near slits 40. Although slits 40 may be formed along any portion of the top edge 38, the present embodiment forms the slits 40 in the vicinity of the index finger stall 15.

The slits 40, notch 60, folds 42, and flexibility seams 43 may each be used alone or in combination with each other to decrease the stiffness of the glove 5. The illustrated embodiment, however, utilizes the notch 60, slits 40, folds 42, and flexibility seams 43 to facilitate opening and closing of the glove 5.

In operation, the present invention provides for easier opening and closing of an athletic glove 5. A new athletic glove 5, therefore, does not need to go through a break-in period prior to effective use during play. In addition to the slits 40 and notch 60, flexibility folds 42 and seams 43 provide for a more flexible glove 5 and allow an individual to better catch a ball during use. The present invention has particular use among ball players having limited hand strength, such as younger or smaller ball players. As a player moves the glove 5 from the open to closed positions, the palm 47 of the front ply 11 bends or creases at the predetermined folds 42 and seams 43. Accordingly, the increased flexibility of the palm 47 of the glove 5 allows for easier opening and closing as there is less resistance from the front and back plies 11 and 12 of the glove 5.

Although the present invention has been described for an athletic glove 5 having a strap 70, one skilled in the art will recognize that the web slits 40, notch 60, folds 42, and flexibility seams 43 can be utilized in a closed back style glove without departing from the scope of the present invention. Instead of an upper peripheral edge 77 of the strap 70 forming an inner opening 74, the glove 5 could include a finger port (not shown) bordered by lacing. The finger port allows an individual to extend an index finger therethrough for enhanced glove control. A separate strap (not shown) cold be fastened or attached to an inner portion of the back ply 12 behind a lower portion, thereby extending through a loop within the back ply 12, such that the separate strap is adapted to adjustably fasten to an outer portion of the back ply 12 by, for example, Velcro™ or other fastening means such as buckles, snaps, lacing, etc.

It should be understood that various changes to the present invention may be made by the ordinarily skilled artisan, without departing from the spirit and scope of the present invention which is presented in the claims below. For example, the web slits 40 may be formed along any portion of an upper edge of a glove web 35. The notch 60, slits 40, folds 42, and flexibility seams 43 may be used on any type of baseball or softball glove regardless of the number of finger stalls 10, 15, 20, 25, and 30. Furthermore, the notch 60 may have any shape which is appropriate for the particular glove 5 on which it is employed. Finally, the notch 60 may be located on any portion of the heal portion 49.

Therefore, while embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. An athletic glove comprising:

a front ply having a first peripheral edge, wherein said front ply forms a palm and a front portion of a glove;

a back ply having a second peripheral edge, wherein said back ply forms a back portion of said glove;

an attachment mechanism for attaching the front ply and the back ply together at said first peripheral edge and second peripheral edge to form said glove, wherein the glove includes:

a thumb stall;

an index finger stall, a middle finger stall, a ring finger stall, and a pinky finger stall; wherein at least one of the finger stalls is separated from other finger stalls by a flexibility seam;

a hand receiving opening;

a heel portion at a lower portion of said front ply;

a web portion positioned between said thumb stall and said index finger stall; and at least two predefined folds in said palm of said front ply, such that each of said at least two predefined folds increases flexibility of said glove and facilitates opening and closing of said glove, wherein each of said at least two predefined folds are defined on the index finger stall and includes a first end positioned between aid hand receiving opening and a second end positioned adjacent said web portion;

a notch formed in said glove, such that said notch increases flexibility of said glove and facilitates opening and closing of said glove, wherein said notch includes first and second notch portions in said front ply and said back ply, respectively, between said at least one finger stall and said hand receiving opening; and wherein each of said at least two predefined folds includes stitching extending from said first end of each of said at least two predefined folds to said second end of each of said at least two predefined folds.

2. The athletic glove of claim 1, wherein said first notch portion and second notch portion are disposed opposite one another at a lower portion of said palm such that said notch extends through an entire cross section of said glove.

3. The athletic glove of claim 1, wherein said first notch portion and said second notch portion are separately bound.

4. The athletic glove of claim 1, wherein said first end of each of said at least two predefined folds is positioned adjacent said notch.

5. The athletic glove of claim 4, wherein said first end of each of said at least two predefined folds is positioned adjacent an apex of said notch.

6. The athletic glove of claim 1, further comprising at least one seam having a first end and a second end, such that said first end of said at least one seam is positioned between at least one of the finger stalls and said hand receiving opening and said second end of said at least one seam is positioned adjacent said at least one finger stall, wherein said at least one seam increases flexibility of said glove and facilitates opening and closing of said glove.

7. The athletic glove of claim 6, further comprising a second seam having a first end and a second end, such that said first end of said second seam is positioned between at least one of the finger stalls and said hand receiving opening and said second end of said second seam is positioned adjacent said thumb stall, wherein said second seam increases flexibility of said glove and facilitates opening and closing of said glove.

8. The athletic glove of claim 1, wherein said web portion includes at least one slit formed on a top edge of said web portion, such that said at least one slit decreases the stiffness of said top edge, thereby facilitating opening and closing of said glove.

9. The athletic glove of claim 1, wherein the first end of each of the at least two predefined folds merge towards each other adjacent the hand receiving opening.

10. The athletic glove of claim 1, wherein the second end of each of the at least two predefined folds extend away from each other adjacent the web portion.

11. A baseball glove comprising:

a front ply having a first peripheral edge, such that said front ply forms a palm and a front portion of a glove;

a back ply having a second peripheral edge, such that said back ply forms a back portion of said glove, wherein said front ply and said back ply are attached together at said first peripheral edge and second peripheral edge to form said glove;

a thumb stall;

an index finger stall, a middle finger stall, a ring finger stall, and a pinky finger stall; wherein at least the index finger stall is separated from other finger stalls by a flexibility seam;

a hand receiving opening;

a heel portion at a lower portion of said front ply;

a web portion positioned between said thumb stall and said index finger stall;

a notch formed in said back portion of said glove, such that said notch increases flexibility of said glove and facilitates opening and closing of said glove, wherein said notch includes first and second notch portions in said front ply and said back ply, respectively, between said at least one finger stall and said hand receiving opening; and at least two predefined folds in said palm of said front ply, such that each of said at least two predefined folds increases flexibility of said glove and facilitates opening and closing of said glove, wherein each of said at least two predefined folds are defined on the index finger stall and includes a first end positioned adjacent said notch and a second end positioned adjacent said web portion.

12. The baseball glove of claim 11, wherein each of said at least two predefined folds includes stitching extending from said first end of each of said at least two predefined folds to said second end of each of said at least two predefined folds.

13. The baseball glove of claim 11, wherein said first notch portion and second notch portion are disposed opposite one another at a lower portion of said palm such that said notch extends through an entire cross section of said glove.

14. The baseball glove of claim 11, wherein said first notch portion and said second notch portion are separately bound.

15. The baseball glove of claim 11, wherein said first end of each of said at least two predefined folds is positioned adjacent an apex of said notch.

16. The baseball glove of claim 11, further comprising at least one seam having a first end and a second end, such that said first end of said at least one seam is positioned adjacent said notch and said second end of said at least one seam is positioned adjacent at least one of the finger stalls, wherein said at least one seam increases flexibility of said glove and facilitates opening and closing of said glove.

17. The baseball glove of claim 16 further comprising a second seam having a first end and a second end, such that said first end of said second seam is positioned adjacent said notch and said second end of said second seam is positioned adjacent said thumb stall, wherein said second seam increases flexibility of said glove and facilitates opening and closing of said glove.

18. The baseball glove of claim 11, wherein said web portion includes at least one slit formed on a top edge of said web portion, such that said at least one slit decreases the stiffness of said top edge, thereby facilitating opening and closing of said glove.

19. The baseball glove of claim 11, further comprising:

a strap formed in said back ply for securing said glove onto an individual's hand and wrist, wherein said strap originates from a portion of said rear ply near said thumb stall and further includes first and second peripheral edges, said first peripheral edge bordering an upper portion of said hand receiving opening, and said second peripheral edge and said lower peripheral edge of said back ply forming an inner opening on said back portion of said glove;

a first section of lacing, such that said first section of lacing fastens said front ply to said rear ply near said thumb stall and fastens a lower portion of said rear ply to a lower portion of said front ply; and a second section of lacing, such that said second section of lacing fastening said front ply to said rear ply near said finger stalls, wherein said notch is disposed between said first and second sections of lacing.

20. The baseball glove of claim 11, wherein the first end of each of the at least two predefined folds merge towards each other adjacent the notch.

21. The baseball glove of claim 11, wherein the second end of each of the at least two predefined folds extend away from each other adjacent the web portion.

22. A baseball glove having a front ply forming a palm and a front portion of a glove, a back ply forming a back portion of said glove, wherein said front ply and said back ply are fastened together along peripheries to form said glove, a thumb stall, an index finger stall, a middle finger stall, a ring finger stall, a pinky finger stall, a hand receiving opening, a web portion positioned between said thumb stall, and said at least one finger stall; the baseball glove comprising:

a notch formed in said back portion of said glove, such that said notch increases flexibility of said glove and facilitates opening and closing of said glove, wherein said notch includes first and second notch portions in said front ply and said back ply, respectively, between said at least one finger stall and said hand receiving opening;

at least two predefined folds in said palm of said front ply, such that each of said at least two predefined folds increases flexibility of said glove and facilitates opening and closing of said glove, wherein each of said at least two predefined folds are defined on the index finger stall and includes a first end positioned adjacent said notch and a second end positioned adjacent said web portion, and further wherein each of the at least two predefined folds merge towards each other adjacent the notch and extend away from each other adjacent the web portion; and at least one predefined seam in said palm of said front ply, such that said at least one predefined seam increases flexibility of said glove and facilitates opening and closing of said glove, wherein said at least one predefined seam includes a first end position adjacent said notch and a second end position adjacent said at least one finger stall.

23. The baseball glove of claim 22, wherein each of said at least two predefined folds includes stitching extending from said first end of said at least one predefined fold to said second end of each of said at least two predefined folds.

* * * * *